US005179796A

United States Patent [19]

Gephart, Jr.

[11] Patent Number: 5,179,796

[45] Date of Patent: Jan. 19, 1993

[54] COUNTER-REVOLVING DISPLAY CAROUSEL

[76] Inventor: Robert J. Gephart, Jr., 232 Culvert St., Jersey Shore, Pa. 17740

[21] Appl. No.: 683,921

[22] Filed: Apr. 11, 1991

[51] Int. Cl.[5] ..... G09F 11/02

[52] U.S. Cl. ..... 40/473; 472/6

[58] Field of Search ..... 40/473, 474, 493, 494, 40/429, 430; 472/32, 35, 41, 42, 6; 74/665 F

[56] References Cited

U.S. PATENT DOCUMENTS

| | | | |
|---|---|---|---|
| 176,590 | 4/1876 | Brigham | 476/6 |
| 515,088 | 2/1894 | Mumbrauer | 472/35 |
| 601,499 | 3/1898 | Crondall | 472/6 |
| 630,003 | 9/1899 | Olson et al. | 472/41 |
| 954,207 | 4/1910 | Reynolds et al. | 472/41 |
| 3,231,995 | 2/1966 | Anthony | 40/473 |

*Primary Examiner*—Kenneth J. Dorner
*Assistant Examiner*—Cassandra Hope
*Attorney, Agent, or Firm*—Armstrong, Nikaido, Marmelstein, Kubovcik & Murray

[57] ABSTRACT

A display device for photographs and/or other decorative and ornamental articles includes a first display assembly having a top plate and bottom plate connected together, a second display assembly located internally of the first display assembly and having a second top plate and a second bottom plate connected together, a suspension including an arrangement for rotatably suspending at least one of the display assemblies, and a stationary arrangement for rotating the bottom plate in one direction and rotating the second bottom plate in an opposite direction.

19 Claims, 7 Drawing Sheets

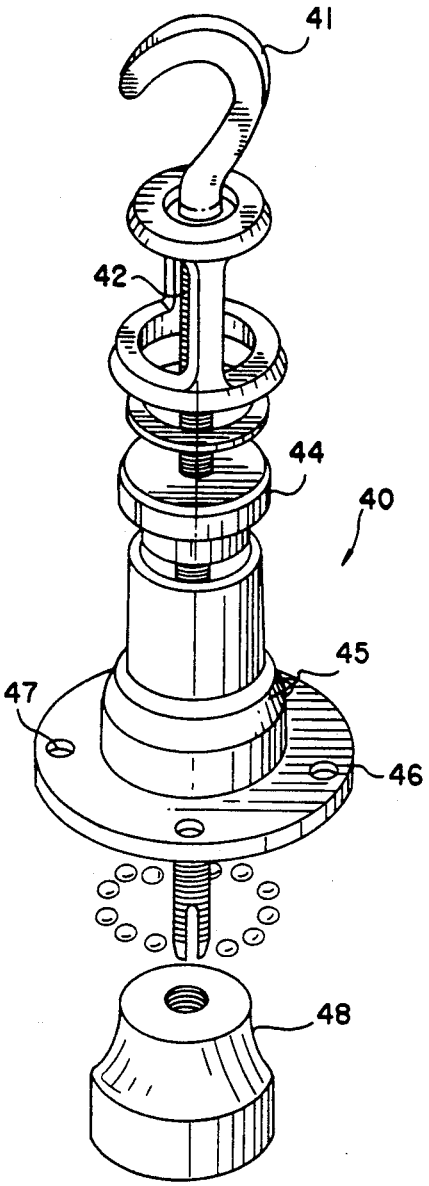
FIG.2
FIG.3
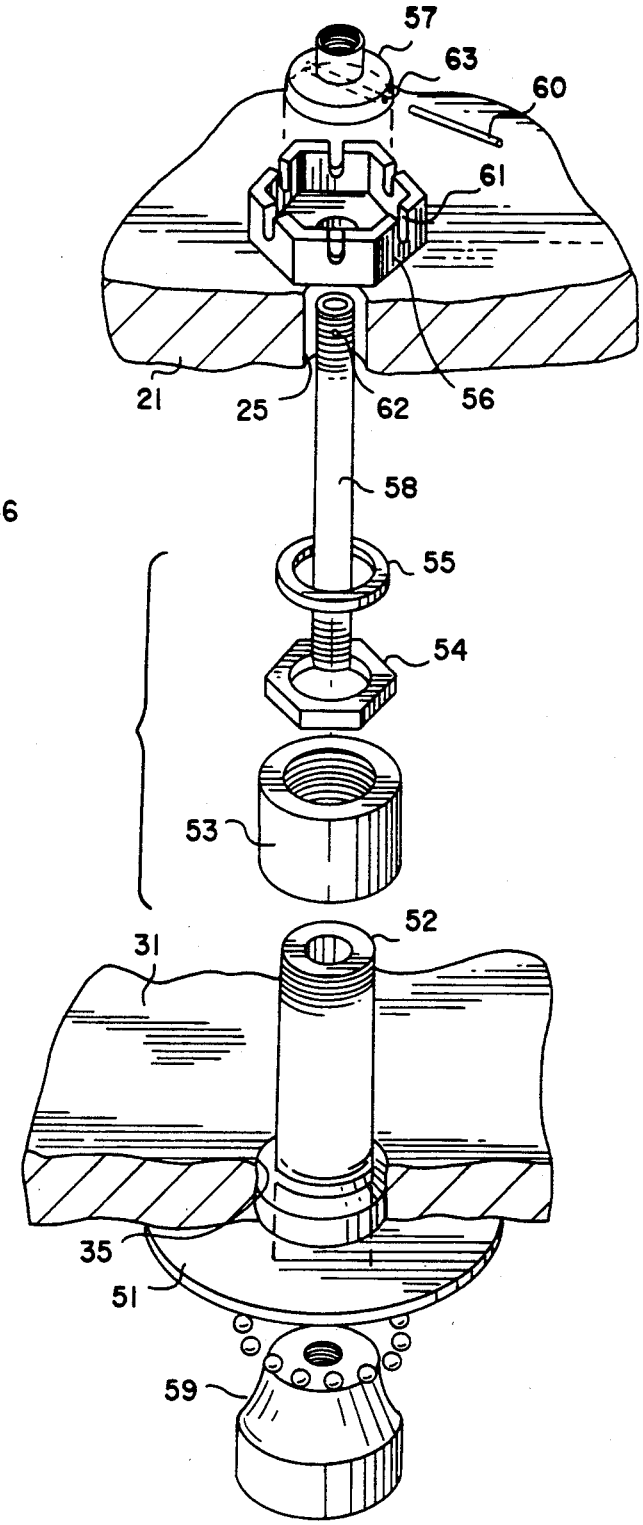

COUNTER-REVOLVING DISPLAY CAROUSEL

The present invention is directed to a display device and, more specifically, to a counter-revolving display device for displaying photographs, cards, and/or other articles of a decorative nature.

BACKGROUND OF THE INVENTION

A number of display devices have been used for both commercial and individual or private display of articles and include various types of racks and frames which may display individual or a number of different articles as well as stands, tables and other fixtures which may be stationary or movable either manually or by motive power. Each of the foregoing devices are suitable and satisfactory for particular purposes such as, for example, when an individual may have a limited number of photographs which may be mounted in one or more frames and displayed on suitable stands and tables. Other stands which accommodate a large number of substantially the same type of articles are useful in commercial applications where a number of the same and a selection of different types of articles such as, for example, a number of different types of greeting cards or items of jewelry are displayed to attract and permit ease of selection by a potential purchaser. However, most of the devices provided for individual use are not capable of displaying a relatively large number of photographs or cards and although the devices provided for commercial use are capable of displaying a relatively large number of articles, such devices are frequently unattractive for individual or personal use and are usually not adaptable to individual modification in the arrangement of preset display patterns or adaptable to accommodate and display different sizes and types of articles.

The present invention obviates many of the shortcomings of the prior art display devices by providing a display device in the form of a carousel including first and second counter-revolving display assemblies which can accommodate and display a relatively large number of photographs, cards and/or other decorative or ornamental articles in various combinations and arrangements suitable for individual viewing. Although the display carousel of the present invention can accommodate a relatively large number of photographs, cards or other articles, such articles may be arranged and displayed in a manner which is aesthetically pleasing to individual viewers without the unsightly appearance of the large commercial types of display racks and stands.

One object of the present invention is to provide a display device including counter-revolving first and second display assemblies which present a constantly changing and thus more interesting display of the photographs and/or other articles arranged for viewing on the display assemblies.

It is a still further object of the present invention to provide a display carousel having counter-revolving first and second display assemblies at least one of which may include a source of electrical power and carry its own lighting display as well as the option of including a built in source of music to accompany the counter-revolving display assemblies.

SUMMARY OF THE INVENTION

The present invention is a display device for photographs and/or other decorative and ornamental articles and includes a first display assembly having a top plate and bottom plate connected together; a second display assembly located internally of the first display assembly and having a second top plate and a second bottom plate connected together, a suspension including an arrangement for rotatably suspending at least one of the display assemblies, and a stationary arrangement for rotating the bottom plate in one direction and rotating the second bottom plate in an opposite direction.

In a preferred embodiment, the first display assembly is rotatably suspended from a suspension device and the second display assembly is rotatably suspended from the top plate of the first display assembly. The bottom plate and the second bottom plate are preferably suspended from the top plate and the second top plate by elongate elements of relatively narrow width such as chains.

The suspension arrangement of the preferred embodiment includes a hanger and a support rotatably mounted to the hanger and the first display assembly is suspended from the support by a number of elements connected between the periphery of the top plate and the support. The second top plate is suspended from the top plate by a bearing assembly permitting relative rotation between the second top plate and the top plate.

The arrangement of the preferred embodiment for rotating the bottom plate includes a motor and gear transmission for driving the bottom plate and the second bottom plate and the motor and gear transmission are suspended beneath the bottom plate.

In the preferred embodiment, the suspension includes a hanger and a support rotatably mounted to the hanger. The second top plate is suspended from the top plate by a hollow bearing assembly permitting relative rotation between the second top plate and the top plate. A chassis plate is suspended from the bottom plate, a motor and gear transmission are carried by the chassis plate and centrally located apertures are provided through the bottom plate and the second bottom plate. A stabilizing rod is secured at one end to the chassis plate and extends through the apertures and the hollow bearing assembly to the hanger where the other end of the stabilizing rod is secured to prevent rotation of the chassis plate.

The preferred embodiment includes first and second counter rotating concentric display assemblies, an arrangement for rotatably suspending the first and second display assemblies, a motor and gear transmission for driving the first and second display assemblies in opposite directions, a chassis plate mounting the motor and gear transmission suspended below the first and second display assemblies and a stabilizing rod secured at one end to the chassis plate and extending upward through the center of the display device to a hanger supporting the arrangement for rotatably suspending the first and second display assemblies where the stabilizing rod is secured to prevent the chassis plate from rotating.

In the preferred embodiment of the invention, the bottom plate of the first display assembly is secured to and rotated by an annular plate spaced by risers from a gear driven by the motor. The chassis plate is suspended by the risers. A second bottom plate of the second display assembly is located above the bottom plate of the first display assembly and is rotated by a hollow tubular member passing through the gear and extending above the annular plate. The stabilizing rod extends upward through the hollow tubular member. A rotary driving connection is also preferably provided which includes a collar having diametrically opposed vertically extending ribs secured to the second bottom plate of the second display assembly, the adapter is a cup shaped member having a hollow interior portion formed with diametrically opposed, vertically extending recesses complementary to the vertically extending ribs.

In the preferred embodiment, the stabilizing rod is provided in the form of a number of segments non-rotatably joined together and optionally may include a surrounding decorative tubular sleeve. The decorative tubular sleeve may include axially spaced radially extending flanges which support one or more rods mounting decorative ornaments.

The display device may also include radially spaced annular brush contacts secured to the underside of the annular plate rotating the bottom plate, stationary electrical brushes supported by the chassis plate, a power lead attached to the electrical brushes and lead lines extending from the brush contacts to the first display assembly to illuminate lights carried by the first display assembly.

The display device may further include a melody sounding device mounted on the chassis plate and an arrangement for selectively actuating the melody sounding device.

The present invention and the advantages provided thereby will be more fully understood with reference to the following detailed description of the preferred embodiment and the claims taken in conjunction with the accompanying drawings.

BRIEF DESCRIPTION OF THE DRAWINGS

FIG. 2 is an enlarged exploded view showing details of the hanger and suspension device of FIG. 1;

FIG. 3 is an exploded view partly in section showing the components utilized for assembling a top portion of the display carousel of FIG. 1;

DESCRIPTION OF THE PREFERRED EMBODIMENT

Figure 1:
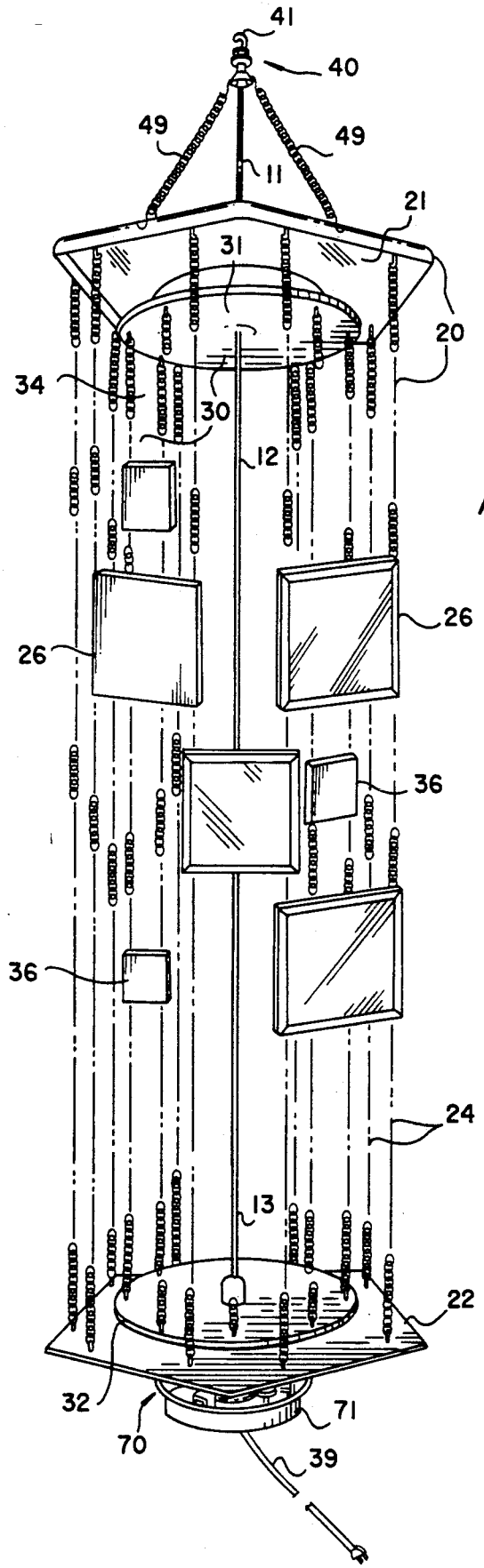
FIG. 1 is a perspective view of the counter-revolving display carousel of the present invention.

With reference to the drawings wherein like reference numerals designate the same or like parts throughout, there is shown in FIG. 1 a counter-revolving display carousel 10 comprised of a first display assembly 20 and a second, inner display assembly 30. The first display assembly includes a top plate 21 and a bottom plate 22 suspended from the top plate by narrow, elongate elements such as chains 24. The second display assembly 30 is located within the first display assembly 20 and includes a second top plate 31 and a second bottom plate 32 suspended from the second top plate by narrow, elongate elements such as the chains 34. The chains 24 and 34 may be of the same size. However, since the second display assembly 30 is of smaller overall dimensions, it is preferred that the chains 34 of the second display assembly 30 also be smaller than the chains 24.

A plurality of photographs 26 are shown supported by the chains 24 of the first display assembly 20. In a similar manner, photographs 36 are supported by the chains 34 of the second display assembly 30. Other decorative or ornamental devices may also be supported by the chains 24 and 34 or, as will be more fully described later by other means carried by the carousel 10. Although the photographs 26 and 36 or other display cards or placards, may all be of the same or different sizes, the display carousel of the present invention is particularly receptive to arrangements wherein the larger display articles such as the photographs 26 are supported by the chains 24 of the first display assembly 20 and spaced apart as shown at the center of FIG. 1 to provide an opening for viewing smaller articles such as the photographs 36 suspended by the chains 34 of the second, inner display assembly 30.

Figure 10:
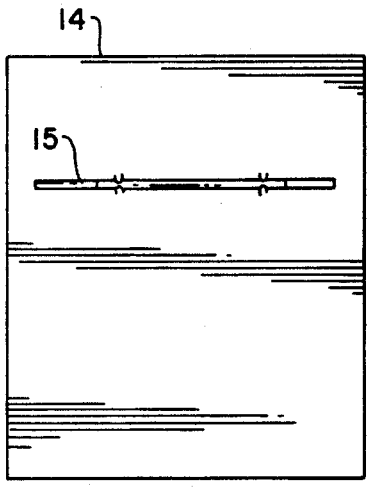
FIG. 10 is a rear elevation of one of the articles shown displayed on the carousel of FIG. 1.
Figure 11:
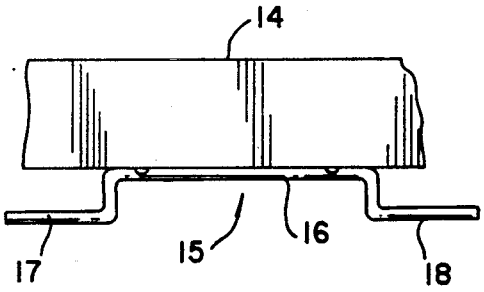
FIG. 11 is a top view of the article shown by FIG. 10.

Any of a number of different types of frames may be utilized for displaying photographs or cards and various types of hooks and hanging devices may be utilized to attach articles to the chains 24 or 34. However, a clear acrylic photo frame 14 having a bent wire hanging bracket 15 as shown by FIGS. 10 and 11 is particularly useful with the display carousel 10. The bent wire hanging bracket 15 is formed to have a central portion 16 attached to the photograph frame 14 and two end portions 17 and 18 which are spaced from the rear surface of the frame 14. The central portion 16 of the wire bracket 15 may be secured to the rear surface of the frame 14 by heating the wire bracket 15 and pressing the central portion 16 against the frame 14 until the thermal energy softens the frame 14 and the bracket 15 is thermally welded to the frame 14. The central portion 16 of the wire hanging bracket 15 may also be secured to the rear surface of the frame 14 with an adhesive. After the bent wire hanging bracket 15 is secured to the rear surface of the photograph frame 14, the ends 17 and 18 are spaced outward from the frame 14 and can be readily inserted through apertures in the links of an adjacent pair of chains 24 or an adjacent pair of chains 34.

As best shown by FIGS. 1-3 of the drawings, the display carousel 10 is supported by a suspension device 40 which includes a hanger 41 in the form of a hook having an internally threaded aperture and a threaded shaft or axle 42 which is threaded into and supported by the hanger 41. A nylon nut 44 and a bearing cup 45 having a flange 46 are provided over the axle 42 and a hub 48 providing a bearing race is threaded to the lower end of the axle 42. The flanged bearing cup 45 is thus rotatably secured between the nylon nut 42 and the hub 48. A plurality of chains 49 are secured at one end by means of hooks to the apertures 47 in flange 46 and at their other ends to the top plate 21 of the first display assembly 20. The first display assembly 20 is thus suspended by means of the chains 49 from the suspension device 40 and is free to rotate with the flanged bearing cup 45 relative to the threaded axle 42 and hanger 41.

The second display assembly 30 is suspended from the top plate 21 of the first display assembly 20 and is suspended in such a manner as to be freely rotatable relative to the top plate 21. With reference to FIG. 3, a bearing cup 51 is seated internally of a central bore 35 provided to the second top plate 31. A tubular extension 52 is threaded to the bearing cup 51. A plastic collar 53 and a nut 54 are then threaded to the tubular extension 52 to secure the second top plate 31 between the flanged bearing cup 51 and the pressure collar 53.

A castellated plastic cup 56 is preferably glued to the upper surface of top plate 21. A washer 55 is then seated on the nut 54 and a hub 59 having a bearing raceway is threaded to the lower end of a threaded tubular member 58. The upper end of the threaded member 58 is then inserted through the bearing cup 51, tubular extension 52, top plate aperture 25 and an aperture in the castellated plastic cup 56. A nylon nut 57 is threaded to the upper end of the member 58 to secure the assembly together with the second top plate 31 and bearing cup 51 rotatable relative to the hub 59 and hollow member 58.

After the nylon nut 57 has been tightened and seated in the plastic cup 56, a pin 60 is inserted through one of the slots 61 and the apertures 62 and 63 respectively provided to the member 58 and nut 57 to secure the member 58 and the hub 59 against rotary movement relative to the top plate 21. The threaded member 58 is tubular and the hollow interior portion remains open at both ends for a purpose to be described later.

The top plate 21 and the second top plate 31 are thus both suspended from the hanger 41 and mounted for rotary movement relative to the hanger 41 and to each other. The rotary movement is provided by a drive mechanism 70 mounted to a chassis plate 71 suspended beneath the bottom plate 22.

Figure 4:
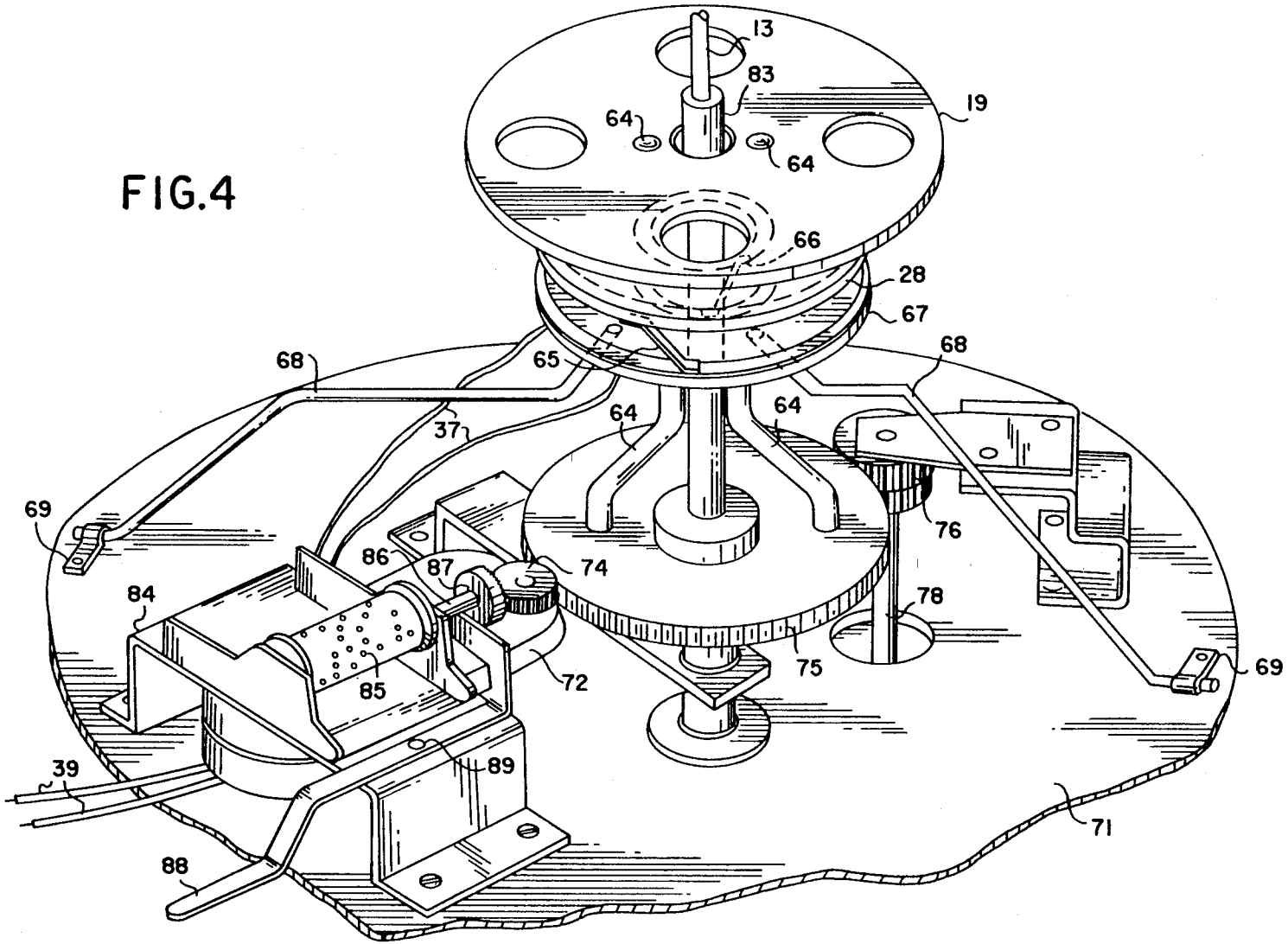
FIG. 4 is a perspective view partly in section showing details of a driving arrangement provided at the bottom or lower portion of the display carousel of FIG. 1.
Figure 5:
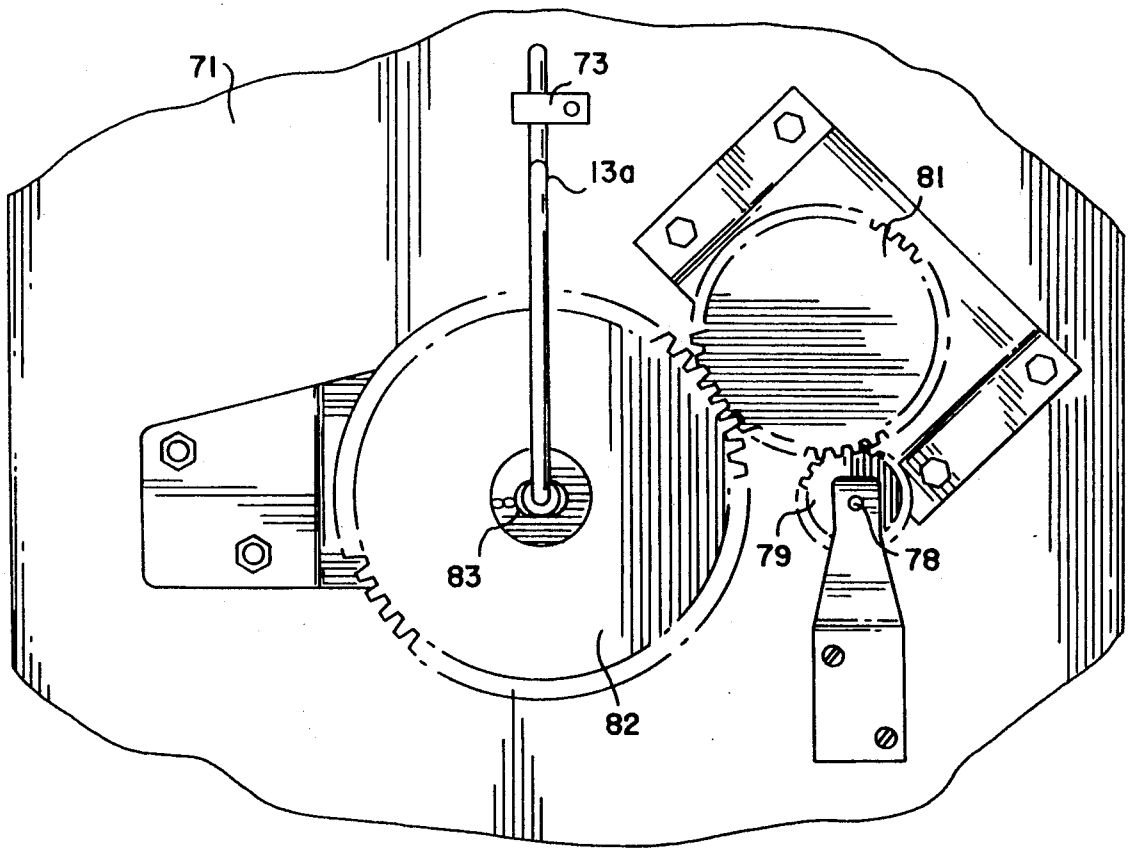
FIG. 5 is a plan view looking upward toward the bottom of the driving arrangement shown by FIG. 4.

With reference to FIGS. 4 and 5, the drive mechanism includes a motor 72 driving an output gear 74 meshed in driving relation to a gear 75 which in turn drives gear 76 and shaft 78. The shaft 78 extends downward through an aperture in the chassis plate 71 and drives the meshed gears 79, 81 and 82 mounted beneath the chassis plate 71 as shown by FIG. 5.

A bracket 84 rotatably mounts a melody sounding device 85 over the motor 72. The melody sounding device 85 is similar to those utilized in music boxes and is rotatably mounted by means of a shaft 86 having a gear 87 secured at one end thereof. A manually actuated lever 88 is pivotally mounted at 89 to the bracket 84 has an end movable into and out of engagement with the shaft 86 to permit engagement and disengagement of the gear 87 with the motor output gear 74 for selectively actuating and disengaging the melody sounding device 85 when the motor 72 is driving gear 74.

A pair of rods or risers 64 are each secured at one end to the upper surface of gear 75 as shown by FIG. 4 and secured at their opposite ends to the lower surface of an annular plate 19 which in turn is secured to the under surface of the bottom plate 22 of the first display assembly 20. The bottom plate 22 of the first display assembly 20 is thus driven, preferably in a clockwise direction as shown in FIG. 1 by the gear 75, risers 64 and plate 19 which carries an annular plate 28 fastened thereto. Once assembled, the first display assembly 20 has sufficient mass that the chains 24 and top plate 21 follow the rotation of the bottom plate 22.

Figure 6:
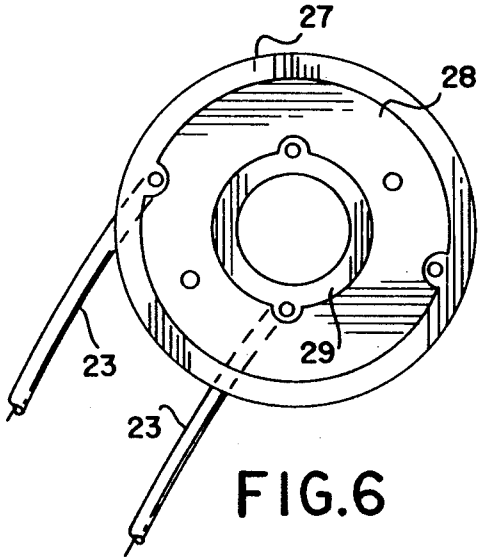
FIG. 6 is also a view looking upward at the bottom of one of the components comprising a part of the driving arrangement shown by FIG. 4.

As shown by FIG. 6, a pair of radially spaced annular brush contacts 27 and 29 are also secured to the underside of the annular plate 28. Lead lines 23 extend from each of the brush contacts 27 and 29 to the first display assembly 20 where they may be selectively utilized to illuminate lights or activate other devices provided thereon.

As shown by FIG. 4, a pair of stationary electrical brushes 65 and 66 are supported by an annular plate 67 and respectively tied by leads 37 to a load line and ground line of a power cord 39 supplying power to the motor 72. The stationary brushes 65 and 66 constantly engage the radially spaced annular brush contacts 27 and 29 provided on the undersurface of the annular plate 28 and provide a source of electrical current to the first display assembly 20 from the power cord 39.

Two support rods 68 are fixed at one end by flanges 69 to the chassis plate 71 and at their other ends to the annular plate 67 to keep the plate 67 stationary while the risers 64 revolve in the center of plate 67 and the plates 19 and 28 revolve above the stationary plate 67.

The second bottom plate 32 is rotatably driven by the gear 82 and a tubular member 83 secured internally of a bore of the gear 82 as shown by FIG. 5 and projecting upward through an interior bore of gear 75 and the interior apertures of the annular plates 28 and 67, and plate 19.

Figure 7:
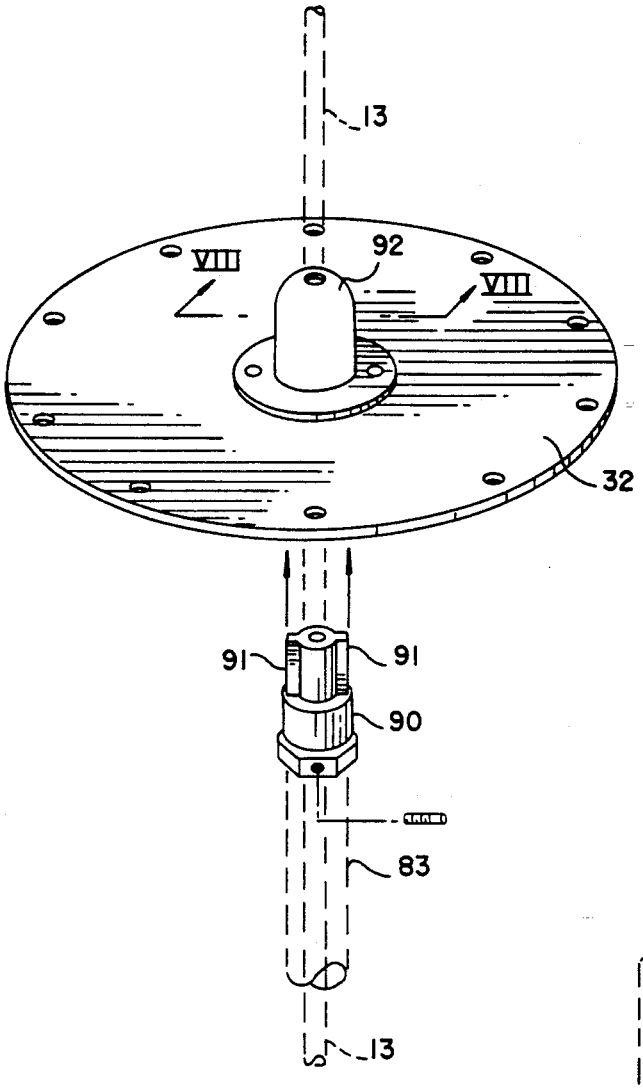
FIG. 7 is a perspective view partly exploded and showing additional components that are associated with the driving arrangement of FIG. 4.
Figure 8:
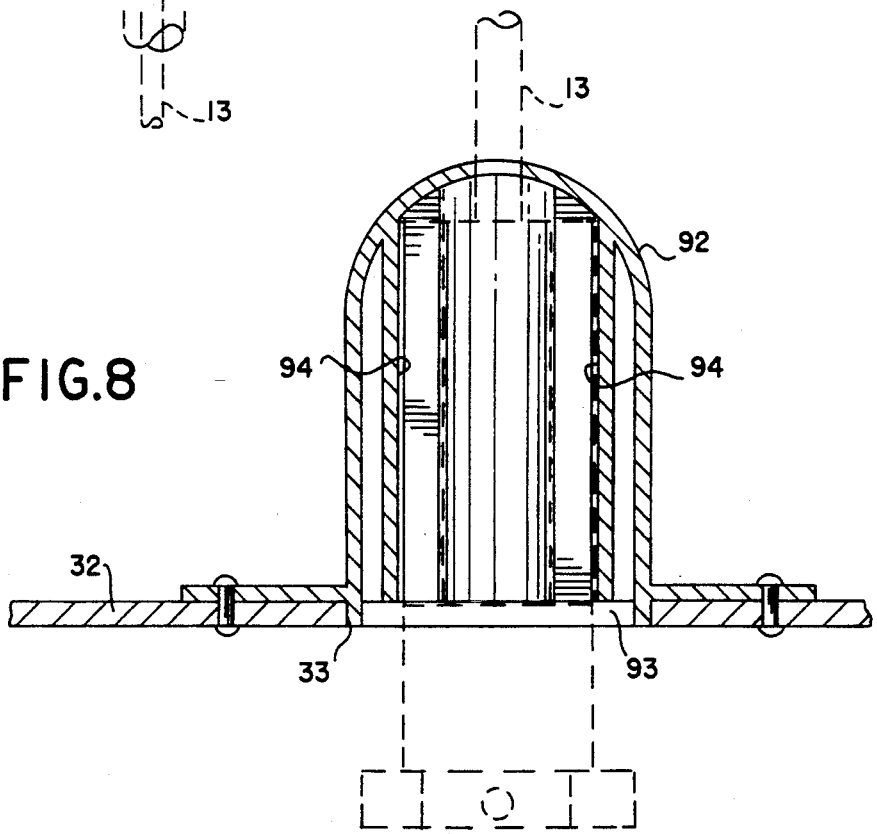
FIG. 8 is a sectional view taken along the line VIII—VIII of FIG. 7.

As best shown by FIGS. 7 and 8, the second bottom plate 32 has a central aperture 33 and the upper end of the tubular member 83 projects upward into the central aperture 33. A collar 90 having diametrically opposed vertically extending ribs 91 is secured by means of a set screw to the top of the hollow tubular member 83. A cup shaped adapter 92 having a hollow interior portion 93 formed with diametrically opposed, vertically extending recesses 94 is secured by means of a flange over the central aperture 33 of the second bottom plate 32. The vertically extending recesses 94 are complimentary to the vertically extending ribs 91 of the collar 90 and receive the same to transmit rotary power from the gear 82 and the hollow tubular member 83 to the second bottom plate 32, preferably rotating the second bottom plate 32 in a counterclockwise direction as viewed in FIG. 1 which of course is counter or opposite to the preferred clockwise rotation of the first display assembly bottom plate 22 as viewed in FIG. 1.

A stabilizer rod is also provided to stabilize or prevent rotation of the drive mechanism and chassis plate 71 while permitting the above described counter rotation of the first and second display assemblies 20 and 30. The stabilizing rod is mostly located centrally of the first and second display assemblies 20 and 30 and is comprised of three sections 11, 12 and 13 as shown by FIGS. 1 and 9 of the drawings.

As previously described, the tubular member 83 is hollow and the threaded tubular member 58 which supports the second top plate 31 below the top plate 21 is also hollow. The stabilizer rod comprised of the sections 11, 12 and 13 thus extends from beneath the chassis plate 71 as shown in FIG. 5 through the hollow tubular member 83 and the threaded tubular shaft 58 to the lower end of the stationary shaft 42. The lower end **13*a* of the stabilizer rod section 13 is bent at a right angle to provide clearance for rotation of the gear 82 and then bent again to approach the undersurface of the chassis plate 71 where it is secured to the chassis plate by means of a clamp 73. The upper ends of the intermediate section 12 and the lower section 13 are each formed with two flats which are received in corresponding flat sided openings in the lower ends of the top section 11 and the intermediate section 12. The flat ends of the lower two sections 12 and 13 received in corresponding flat sided recesses provided in the lower ends of the upper sections 11 and 12 prevent the stabilizer rod sections from rotating relative to each other. The upper end of the upper most section 11 is threaded and can be engaged by means of an internally threaded sleeve to the lower end of the threaded axle 42. Thus, although the first and second display assemblies 20 and 30 are driven to revolve in opposite directions by the drive mechanism 70, the chassis plate 71 and drive mechanism 70 are prevented from rotating by the stabilizer rod sections 11, 12 and 13 which are secured at one end to the undersurface of the chassis plate 71 and threaded at the opposite end to the stationary hanger 41**.

Figure 9:
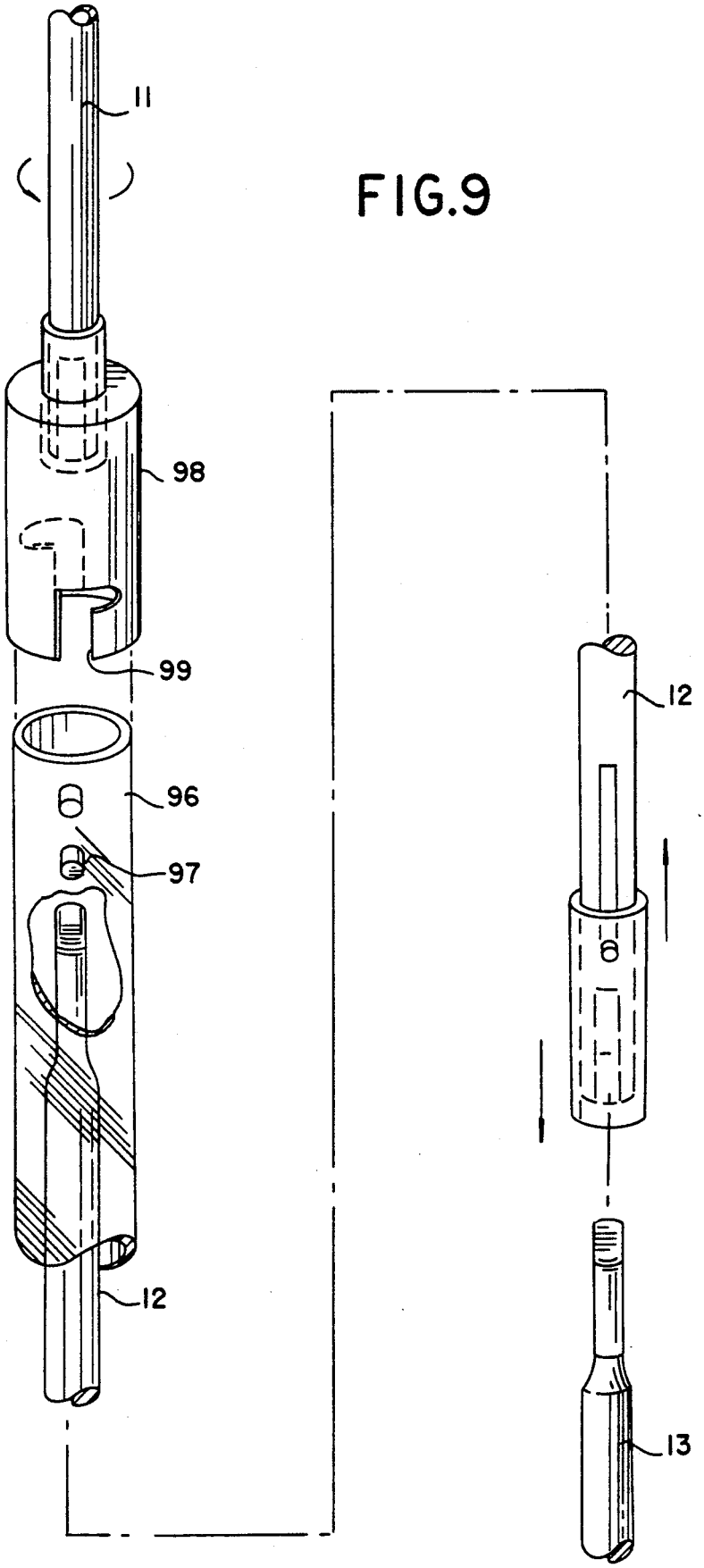
FIG. 9 is an enlarged, exploded view showing details of the assembly of certain components of the display carousel shown by FIG. 1.

As shown by FIG. 9, the sections 12 and 13 of the stabilizer rod may be provided internally of a hollow plastic sleeve 96 to enhance the appearance of the display carousel in the most visible area between the top and bottom plates 31 and 32 of the second display assembly. The sleeve 96 as shown by FIG. 9 is provided with a pair of diametrically opposed radially extending pins 97. A telescopically receiving sleeve 98 is fixed or otherwise suspended adjacent the lower end of the upper rod section 11. A pair of bayonet type receiving slots 99 are provided in the sleeve 98 to receive the diametrically opposed radially extending pins 97 of sleeve 96 and hold the sleeve 96 suspended therefrom when the pins are rotated to seat in the upper portions of the bayonet type recesses 99.

Figure 12:
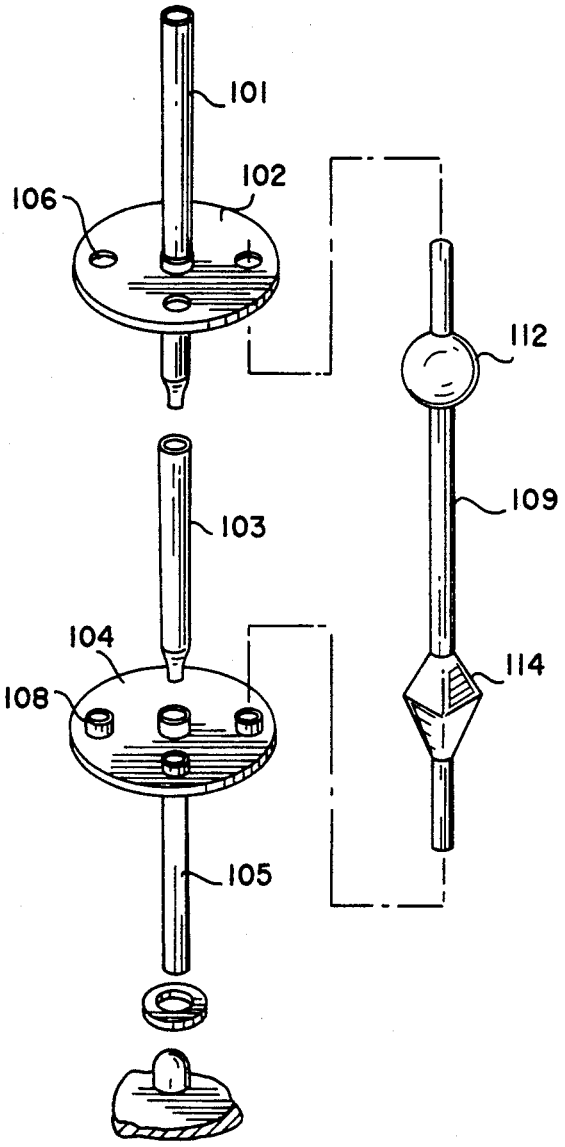
FIG. 12 is an exploded view showing an alternate arrangement for displaying ornamental articles on the carousel shown by FIG. 1.

An alternate arrangement for covering the intermediate portion of the stabilizer rod sections and mounting additional decorative and/or ornamental display devices is shown in FIG. 12. With reference to FIG. 12, there is shown a decorative tubular sleeve for surrounding a portion of the stabilizing rod internally of the second display assembly 20 which includes three tubular sections 101, 103 and 105. The lower ends of the tubular sections 101 and 103 are tapered so as to be slidably or telescopically received internally of the upper ends of the tubular sections 103 and 104, respectively. The tubular sections 101 and 105 are each provided with a radially extending flange 102 and 104, respectively. The flange 102 is provided with a plurality of circumferentially spaced apertures 106 and the flange 104 is provided with a plurality of circumferentially spaced bosses 108. The location of the bosses 108 in flange 104 correspond generally to the location of the apertures 106 in flange 102 and are adapted to receive the upper and lower ends of an axially extending rod such as the rod 109. The rod 109 is provided with a pair of spaced decorative ornaments 112 and 114 which would be located radially inside the second display assembly 30 and decorative devices such as the ornaments 112 and 114 may thus provide a complimentary or contrasting background internally of the counter revolving first and second display assemblies 20 and 30.

Although a single preferred embodiment of the invention has been disclosed, the present invention is not to be construed as limited to the particular form disclosed herein since the foregoing description is to be regarded as illustrative rather than restrictive and it should be understood that modifications and variations in the details and construction of the display device may be made without departing from the spirit and scope of the invention as defined by the claims appended hereto.

I claim:

1. A display device comprising:

a first display assembly including a first top plate, a first bottom plate and means connecting said first top and first bottom plates, a second display assembly including a second top plate, a second bottom plate and means connecting said second top plate and said second bottom plate, said second display device located between said first top and bottom plates of said first display assembly, a suspension device including means rotatably suspending at least one of said display assemblies, drive means to rotate said first bottom plate in one direction and to rotate said second bottom plate in a direction opposite to said one direction, and means preventing rotation of said drive means.

2. A display device as defined by claim 1 wherein said first display assembly is rotatably suspended from said suspension device and said second display assembly is rotatably suspended from said first top plate of said first display assembly.

3. A display device as defined by claim 2 wherein said first bottom plate and said second bottom plate are respectively suspended from said first top plate and said second top plate by elongate elements of relatively narrow width.

4. A display device as defined by claim 3 wherein said elongated elements are chains.

5. A display device as defined by claim wherein said suspension device includes a hanger and a support rotatably mounted thereto and said first display assembly is suspended from said support by a plurality of linear elements connected between a periphery of said first top plate and said support.

6. The display device as defined by claim 5 wherein said second first top plate is suspended from said top plate by a bearing assembly means permitting relative rotation between said second top plate and said first top plate.

7. The display device as defined by claim 1 wherein said drive means includes a motor and gear transmission adapted for driving said first bottom plate and said second bottom plate, wherein said motor and gear transmission are suspended beneath said bottom plate.

8. The display device as defined by claim 1 wherein said suspension device includes a hanger and a support rotatably mounted thereto, said second first top plate is suspended from said top plate by a hollow bearing assembly means permitting relative rotation between said second top plate and said first top plate, and further including a chassis plate beneath said first bottom plate, a motor and gear transmission adapted for driving said first bottom plate and said second bottom plate carried by said chassis plate, centrally located apertures through said bottom plate and said second bottom plate, and a stabilizing rod secured at one end to said chassis plate and extending through said apertures and said hollow bearing assembly means to said hanger where the other end of said stabilizing rod is secured to support and prevent rotation of said chassis plate.

9. A display device comprising first and second counter rotating concentric display assemblies, wherein said second display assembly is located internally of said first display assembly means rotatably suspending said first and second display assemblies, a motor and gear transmission for driving said first and second display assemblies in opposite directions, a chassis plate mounting said motor and gear transmission below said first and second display assemblies and a stabilizing rod secured at one end to said chassis plate and extending upward through the center of said display assemblies to a supporting means of said means rotatably suspending said first and second display assemblies where said stabilizing rod is secured to support said chassis plate and prevent said chassis plate from rotating.

10. The display device defined by claim 9 wherein a first bottom plate of said first display assembly is secured to and rotated by an annular plate spaced by a plurality of risers from a gear driven by said motor, a second bottom, plate of said second display assembly located above said first bottom plate of said first display assembly and rotated by a hollow tubular member passing through a center of said gear and extending above said annular plate wherein and said stabilizing rod extends upward through said hollow tubular member.

11. The display device defined by claim 10 further including a rotary driving connection comprising a collar having diametrically opposed vertically extending ribs secured to said hollow tubular member and an adapter secured to said second bottom plate of said second display assembly, said adapter comprising a cup shaped member having a hollow interior portion formed with diametrically opposed, vertically extending recesses complementary to said vertically extending ribs.

12. The display device defined by claim 9 wherein said stabilizing rod comprises a plurality of segments non-rotatably joined together.

13. The display device defined by claim 12 wherein one end of each of said segments is formed with a pair of flat sides insertable within a correspondingly flat sided recess provided in an end of the adjacent segment.

14. The display device defined by claim 9 further including a decorative tubular sleeve surrounding a portion of said stabilizing rod internally of said second display assembly.

15. The display device defined by claim 14 wherein said decorative tubular sleeve supports at least two axially spaced radially extending flanges.

16. The display device defined by claim 15 wherein said axially spaced radially extending flanges support an axially extending rod mounting at least one decorative ornament.

17. The display device defined by claim 10 further including radially spaced annular brush contacts secured to an underside of said annular plate, stationary electrical brushes supported by said chassis plate, a power lead including a load and ground line respectively attached to said electrical brushes and lead lines extending from said brush contacts to said first display assembly.

18. The display device defined by claim 17 further including a plurality of lights illuminated by said lead lines on said first display assembly.

19. The display device defined by claim 9 further including a melody sounding device mounted on said chassis plate, means for driving said melody sounding device and manually actuated means for engaging said means for driving said melody sounding device with said gear transmission to activate said melody sounding means.

* * * * *